United States Patent [19]

Mowbray et al.

[11] 4,228,960

[45] Oct. 21, 1980

[54] LIQUID FUEL INJECTORS

[75] Inventors: Dorian F. Mowbray, Burnham; Stephen Edwards, Sible Hedingham, both of England

[73] Assignee: Lucas Industries Limited, Birmingham, England

[21] Appl. No.: 938,022

[22] Filed: Aug. 30, 1978

[30] Foreign Application Priority Data

Sep. 9, 1977 [GB] United Kingdom ..... 37681/77

[51] Int. Cl.[3] ..... F02M 61/20

[52] U.S. Cl. ..... 239/533.9

[58] Field of Search .... 239/533.3, 533.9, 533.4–533.8, 239/533.11, 533.12, 120

[56] References Cited

U.S. PATENT DOCUMENTS

| | | | |
|---|---|---|---|
| 3,055,593 | 9/1962 | May | 239/533.7 X |
| 3,817,456 | 6/1974 | Schlappkohl | 239/533.5 |
| 3,934,903 | 1/1976 | Hofmann | 239/533.3 X |

*Primary Examiner*—Richard A. Schacher

[57] ABSTRACT

A fuel injector has a chamber into which fuel leaking from within the injector can flow. A collar surrounds a body part of the injector and defines with the body a cavity into which fuel from the chamber can flow. The collar is secured to the body part by a circlip and the collar has nipples to lead fuel away from the cavity.

10 Claims, 4 Drawing Figures

LIQUID FUEL INJECTORS

This invention relates to a liquid fuel injector of the kind which in use, is intended to be mounted on an internal combustion engine at a position to direct fuel into a combustion space of the engine, and which comprises an elongated body part having a liquid fuel inlet at or adjacent one end thereof and an outlet orifice at or adjacent to the other end, a valve member slidably mounted within a bore defined in the body part, resilient means acting on the valve member to urge the valve member into contact with a seating thereby to prevent flow of fuel through said orifice, a surface defined on the valve member and against which fuel member pressure can act to lift the valve member from said seating thereby to allow fuel to flow through said orifice.

Such injectors are well known in the art. One problem is the disposal of the fuel which leaks along the small clearance defined between the valve member and the wall of the bore in which it is located. This fuel is allowed to collect in a chamber defined in the body part and which communicates with an outlet on the exterior of the body part. The outlet must be connected to a pipe so that the fuel flowing through the outlet can be conveyed to a convenient point and not allowed to flow over the engine.

The object of the invention is to provide an injector of the kind specified in which the connection of the outlet to a pipe can be achieved in a simple manner.

According to the invention an injector of the kind specified comprises an outlet for fuel leaking between the valve member and the wall of the bore in which it is located, said outlet breaking out onto the periphery of the body part at a position adjacent said fuel inlet, a collar surrounding the body part and defining with the body part a cavity into which fuel can flow from said outlet, said collar having formed integrally therewith a nipple or nipples in which is found a flow passage or flow passages in communication with said cavity, a circlip engageable within a groove within the body part to hold the collar in assembly with the body part, and a pair of sealing means to prevent the escape of fuel from the cavity other than through said flow passage or passages.

Two examples of an injector in accordance with the invention will now be described with reference to the accompanying drawings in which.

Figure 1:
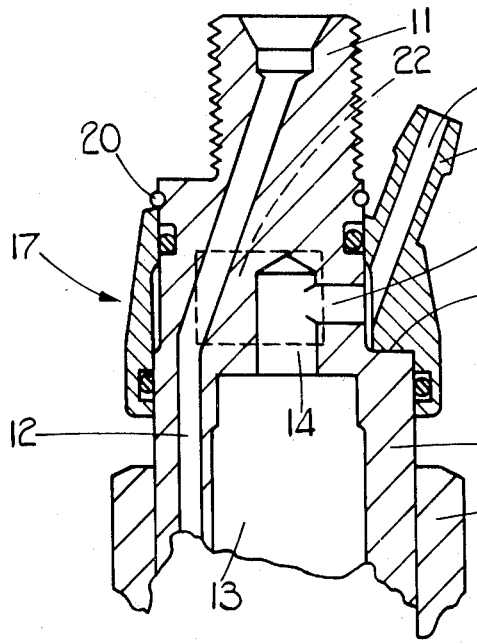
FIG. 1 is a sectional side elevation showing one part of an injector.
Figure 2:
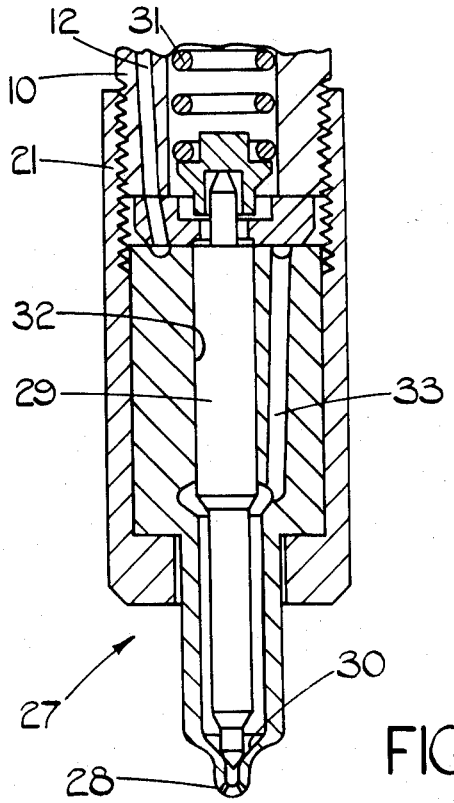
FIG. 2 is a sectional side elevation showing the other part of the injector to an enlarged scale.
Figure 3:
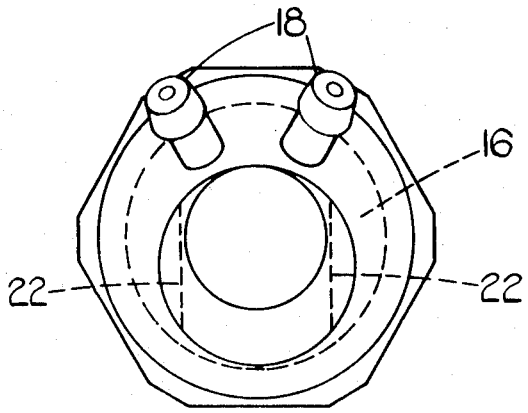
FIG. 3 is a plan view of the injector shown in FIG. 1.

With reference to FIGS. 1, 2 and 3 of the drawings the injector comprises a body part 10 which is of elongated form and has at one end a fuel inlet 11. At its other end is a nozzle head 27 which is provided at its end remote from the inlet 11, with an outlet orifice 28 through which fuel supplied to the inlet 11 can flow into a combustion space of an associated engine. Within the nozzle head there is slidably mounted a valve member 29 which can co-operate with a seating 30 to prevent flow of fuel between the inlet and the outlet orifice. The valve member is urged into contact with the seating by means of resilient means in the form of a coiled compression spring 31. The valve member is located within a bore 32 formed in the nozzle head and a passage 33 formed in the nozzle head communicates with a passage 12 formed in the body and communicating with the inlet 11. The valve member is provided with a surface against which fuel under pressure supplied through the inlet 11, can act so as to lift the valve member away from its seating and thereby allow flow of fuel through the outlet orifice.

The coiled compression spring is located within a chamber 13 formed in the body part and fuel which leaks past the small clearance defined between the valve member 29 and the wall of the bore 32 in which it is located, collects in the chamber 13.

Injectors of the type described above are well known in the art and it is also known that the fuel which collects in the chamber 13 must be allowed to flow to a drain. For this purpose the chamber 13 communicates with a blind axially extending passage 14 and this in turn communicates with an outlet 15 which extends to the periphery of the body part.

The body part 10 is of generally cylindrical form but a portion thereof which lies between the inlet 11 and the chamber 13 is of reduced diameter and also has its axis offset from the axis of the remaining portion of the body part. There is thus defined on the body part a crescent-shaped step 16, and conveniently the outlet 15 opens onto the periphery of the body part where the step 16 has its largest radial dimension.

The injector also includes a collar generally indicated at 17. The collar 17 is conveniently formed as a pressure die-casting and is formed integrally with a pair of nipples 18 which contain flow passages 19. The nipples are inclined relative to the axis of the body part of the injector.

The collar since it must fit over the portion of the body part having the smaller diameter and the portion of the body part having the larger diameter, must be suitably shaped. As a result the collar defines a crescent-shaped portion for engagement with the ledge or step 16. Moreover, defined in the internal peripheral surface of the collar is a groove which defines with the reduced portion of the body part, a cavity into which the outlet 15 opens. The aforesaid flow passages 19 also open into this cavity so that any fuel which flows into the chamber 13 can escape through the flow passages 19. In use, a plastics or other fuel resistant resilient tube is pushed over the nipples to convey away the fuel which has leaked into the chamber 13.

Conveniently the collar is retained on the body by means of a circlip 20 which is located within a groove formed in the portion of the body part of reduced diameter.

It is essential to prevent any fuel leaking from said cavity other than through the flow passages 19 and this is achieved by providing a pair of sealing means conveniently "O" rings which are located within grooves disposed on opposite sides of the cavity in the reduced portion of the body part and the collar respectively. The collar 17 is fitted to the body part after the assembly of the injector. As shown, and in most cases, the aforesaid nozzle head 27 is detachable and is retained relative to the remaining portion of the body part by means of a nut which is generally indicated at 21 in FIGS. 1 and 2. This nut must be tightened to a considerable value of torque and the remaining portion of the body part must therefore be gripped. The gripping is facilitated by a pair of flats 22 which are shown in dotted outline in FIGS. 1 and 2. It will be noted that the flats are formed on the reduced portion of the body part and after tightening of the nut 21, the collar 17 can be placed in position.

It will be noted that the overall diameter of the injector shown in FIGS. 1 and 3 is not materially increased by the provision of the collar and the associated nipples. This is because of the formation of the crescent-shaped step 16. If the overall diameter is not important then there is no need to provide the portion of reduced diameter and the nipples 18 would then extend outwardly beyond the remaining portion of the injector.

Figure 4:
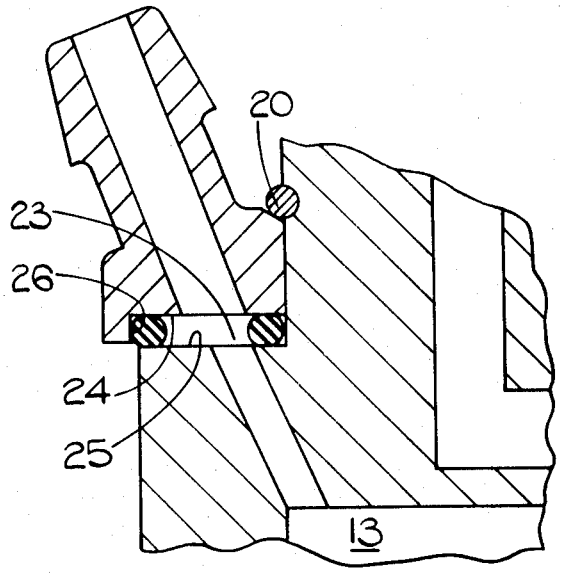
FIG. 4 shows a modification.

A slightly different arrangement is utilised in FIG. 4. In this case the aforesaid cavity is disposed generally in a plane normal to the longitudinal axis of the injector as compared with the cavity in the arrangement shown in FIG. 1. In FIG. 4 the cavity is referenced 23 and it is defined between a surface 24 on the collar and a surface 25 on the body portion of the injector. The collar again is provided with an integral nipple or nipples and a wall 26 is defined at the outer periphery of the surface 24. As with the previous example a pair of sealing means are provided in the form of O-rings to prevent the escape of fuel from the cavity 23 other than through the flow passage defined in the nipple. One of the "O" rings is disposed adjacent the wall 26 whilst the other ring is disposed adjacent the portion of the body part defining the inlet. Also the collar is retained relative to the body part by means of a circlip 20 but in this case the groove in which the circlip is located must be such that when the circlip 20 is located in the groove the O-rings are subject to deformation so as to achieve a fuel tight seal.

We claim:

1. A liquid fuel injector of the kind which in use, is intended to be mounted on an internal combustion engine at a position to direct fuel into a combustion space of the engine, the injector comprising an elongated body part having a liquid fuel inlet at or adjacent one end thereof and an outlet orifice at or adjacent the other end, a valve member slidably mounted within a bore defined in the body part, resilient means acting on the valve member to urge the valve member into contact with a seating thereby to prevent flow of fuel through said orifice, a surface defined on the valve member and against which fuel under pressure can act to lift the valve member from the seating thereby to allow fuel flow through the orifice, an outlet for fuel leaking between the valve member and the bore, said outlet breaking out onto the periphery of the body part at a position adjacent said fuel inlet, a collar surrounding the body part and defining with the body part a cavity into which fuel can flow from said outlet, said collar having formed integrally therewith a nipple or nipples in which is formed a flow passage or flow passages in communication with said cavity, a circlip engageable within a groove within the body part to hold the collar in assembly with the body part, and a pair of sealing means to prevent the escape of fuel from the cavity other than through said flow passage or passages.

2. An injector according to claim 1 in which said circlip acts to retain the collar adjacent a shoulder defined on the body part.

3. An injector according to claim 1 in which said cavity is in part defined by a surface of the body part which lies substantially parallel to the axis of the injector.

4. An injector according to claim 3 in which said surface of the body part is a plain cylindrical surface and is eccentrically disposed relative to the longitudinal axis of the body and the remaining portion of the body part so that a crescent-shaped shoulder is defined on the body part, said circlip acting to retain the collar in engagement with said shoulder.

5. An injector according to claim 4 in which said collar has a first portion surrounding said plain cylindrical surface and a second portion surrounding part of the remaining portion of the body part, so as to define a crescent-shaped surface for engagement with said shoulder, said nipple or nipples extending from the collar in the region of said crescent-shaped surface.

6. An injector according to claim 5 in which said nipples are inclined relative to the axis of the injector.

7. An injector according to claim 6 in which said cavity is in part defined by a circumferential recess defined on the internal surface of the collar.

8. An injector according to claim 7 in which said pair of sealing means comprises "O" rings, one of said rings being located in a groove formed in the body part and the other of said rings being located within a groove located in the collar.

9. An injector according to claim 1 in which said cavity is defined between a pair of opposed surfaces of the collar and body part, said pair of sealing means defining the other walls of the cavity.

10. An injector according to claim 9 in which said opposed surfaces are annular surfaces extending substantially normal to the axis of the injector, said pair of sealing means comprising a pair of "O" rings, the rings being sandwiched between said surfaces and held under compression by said circlip.

* * * * *